US009156672B2

(12) United States Patent
Guerette et al.

(10) Patent No.: US 9,156,672 B2
(45) Date of Patent: Oct. 13, 2015

(54) LIQUID DISPENSING SYSTEM HAVING A PORTABLE HANDHELD ACTIVATOR

(71) Applicants: CONTROLES BVL LTEE, Bois-des-Filion (CA); BO SYSTEMES INC., Blainville (CA)

(72) Inventors: Gilles Guerette, Laval (CA); Robert Beaudoin, Blainville (CA)

(73) Assignees: CONTROLES BVL LTEE, Bois-des-Filion, Quebec (CA); BO SYSTEMES INC., Blainville, Quebec (CA)

( * ) Notice: Subject to any disclaimer, the term of this patent is extended or adjusted under 35 U.S.C. 154(b) by 0 days.

(21) Appl. No.: 14/045,253

(22) Filed: Oct. 3, 2013

(65) Prior Publication Data

US 2014/0034686 A1 Feb. 6, 2014

Related U.S. Application Data

(63) Continuation of application No. PCT/CA2012/050248, filed on Apr. 19, 2012.

(60) Provisional application No. 61/477,841, filed on Apr. 21, 2011.

(51) Int. Cl.
*B67D 1/00* (2006.01)
*B67D 3/00* (2006.01)

(52) U.S. Cl.
CPC ..... *B67D 3/0041* (2013.01); *B67D 3/0003* (2013.01); *B67D 3/0051* (2013.01); *B67D 3/0077* (2013.01)

(58) Field of Classification Search
CPC ..... B67D 7/06
USPC ..... 222/30, 37–38, 52, 63, 129.3, 164, 166, 222/333, 544–546, 566–567, 504
See application file for complete search history.

(56) References Cited

U.S. PATENT DOCUMENTS 3,170,597 A 2/1965 Reichenberger
3,258,166 A 6/1966 Kuckens (Continued)

FOREIGN PATENT DOCUMENTS

AT 405276 B 6/1999
CH 678095 A5 7/1991

(Continued)

OTHER PUBLICATIONS

IPRP for PCT/CA2012/050248 mailed on Jun. 20, 2012 by the Canadian Intellectual Property Office.

*Primary Examiner* — Paul R Durand
*Assistant Examiner* — Andrew P Bainbridge
(74) *Attorney, Agent, or Firm* — IPAXIO S.E.N.C.

(57) ABSTRACT

The system includes a spout and a portable handheld activator insertable around the spout. The spout includes a valve member made of a magnetically-conductive material. The valve member is movable between a closed position and an opened position so as to close or open a fluid passage inside the spout. The spout also includes a core plate made of a magnetically-conductive material. The activator includes a housing made of a magnetically-conductive material, and at least one coil located into the housing to selectively generate an electromagnetic field capable of moving the valve member to the opened position against a spring force biasing the valve member into the closed position. In use, the spout and the activator are configured and disposed so that the electromagnetic field, using only a relatively small amount of electrical energy, creates a substantially uninterrupted toric magnetic circuit for actuating the valve member.

40 Claims, 9 Drawing Sheets

(56) References Cited

U.S. PATENT DOCUMENTS

| | | | | |
|---|---|---|---|---|
| 3,627,176 | A * | 12/1971 | Sailors | 222/290 |
| 3,920,149 | A * | 11/1975 | Fortino et al. | 222/1 |
| 3,993,218 | A | 11/1976 | Reichenberger | |
| 4,278,186 | A | 7/1981 | Williamson | |
| 4,795,060 | A | 1/1989 | Albrecht | |
| 5,044,521 | A | 9/1991 | Peckels | |
| 5,255,819 | A | 10/1993 | Peckels | |
| 5,295,611 | A | 3/1994 | Simard | |
| 5,505,349 | A | 4/1996 | Peckels | |
| 5,507,411 | A | 4/1996 | Peckels | |
| 5,603,430 | A | 2/1997 | Loehrke et al. | |
| 5,702,032 | A * | 12/1997 | Loehrke | 222/63 |
| 5,731,981 | A | 3/1998 | Simard | |
| 5,769,271 | A | 6/1998 | Miller | |
| 6,036,055 | A * | 3/2000 | Mogadam et al. | 222/23 |
| 6,354,468 | B1 * | 3/2002 | Riek | 222/129.3 |
| 6,662,976 | B2 * | 12/2003 | Jensen et al. | 222/481.5 |
| 6,892,166 | B2 | 5/2005 | Mogadam | |
| 6,994,234 | B2 * | 2/2006 | de Leeuw | 222/504 |
| 7,573,395 | B2 | 8/2009 | Morrison et al. | |
| 7,900,799 | B2 | 3/2011 | Kuzar et al. | |
| 2005/0263547 | A1 | 12/2005 | Jensen et al. | |
| 2006/0027268 | A1 | 2/2006 | Zapp | |
| 2008/0195251 | A1 | 8/2008 | Milner | |
| 2009/0230157 | A1 | 9/2009 | Lindberg | |
| 2009/0277931 | A1 | 11/2009 | Zapp | |
| 2010/0038378 | A1 | 2/2010 | Gabler et al. | |
| 2011/0180563 | A1 | 7/2011 | Fitchett et al. | |

FOREIGN PATENT DOCUMENTS

| | | | |
|---|---|---|---|
| DE | 2548442 | A1 | 5/1977 |
| DE | 9303504 | U1 | 8/1993 |
| DE | 19742396 | A1 | 4/1999 |
| EP | 0212467 | A2 | 3/1987 |
| EP | 0517172 | A1 | 12/1992 |
| EP | 0586330 | A1 | 3/1994 |
| EP | 1978338 | A2 | 10/2008 |
| GB | 1092249 | A | 11/1967 |
| WO | 9732284 | A1 | 9/1997 |
| WO | 0242199 | A1 | 5/2002 |
| WO | 2012142708 | A1 | 10/2012 |

* cited by examiner

LIQUID DISPENSING SYSTEM HAVING A PORTABLE HANDHELD ACTIVATOR

CROSS-REFERENCE TO RELATED APPLICATIONS

The present application is a continuation of PCT patent application No. PCT/CA2012/050248 filed on 19 Apr. 2012, which claims priority to U.S. patent application No. 61/477,841 filed on 21 Apr. 2011. The entire contents of these related applications are hereby incorporated by reference.

TECHNICAL FIELD

The technical field relates generally to dispensing systems for liquids in containers such as bottles or the like.

BACKGROUND

Various systems have been suggested in the past to manage access to liquids in containers, for instance bottles with an alcoholic beverage. These systems are generally designed to control who is authorized to pour a quantity of liquid from a given bottle and/or to meter the quantity of liquid being poured. Some systems can also record each transaction in a database. These systems are useful to bar owners for accounting all servings being made. Among other things, it makes it very difficult for an employee to serve unauthorized free or generous drinks to friends or preferred customers.

Dispensing systems often include spouts mounted on bottles, where each spout has an internal spring-biased valve that can be opened using an electromagnetic field generated therein or by a handheld device positioned on the spout. The valve normally closes the fluid passage inside the spout. The electromagnetic field must create a force sufficient to open the fluid passage for a given time while the bottle is upside-down, after which the spout is closed once again. See for instance U.S. Pat. No. 3,920,149 (Fortino et al.) issued 18 Nov. 1975.

Many of the proposed arrangements use a hard-wired connection to the handheld device for the supply of the electrical power required to generate the electromagnetic field. Other arrangements, such as the one disclosed in U.S. Pat. No. 6,036,055 (Mogadam et al.) issued 14 Mar. 2000, suggest using a handheld device running on battery power.

Existing arrangements involving a hard-wired connection with the handheld device are not per se portable because they can only be used within the range permitted by the length of the electric wire and the available locations where the electric wire can be plugged in. Still, when the electrical energy comes from an external power source using a hard-wired connection, the electrical energy consumption within the handheld device is not necessarily a prime interest. However, minimizing the electrical energy consumption is highly desirable when using a battery power pack. Existing devices are relatively limited in autonomy because the electromagnetic field to move the valve during each serving requires a lot of electrical energy from the battery power pack. This may force a barman to recharge the battery power pack during a same shift or to use more than one handheld device, for instance. Increasing the battery capacity is a possible solution but this has an adverse impact on at least one among costs, weight and size of the battery power pack. Other factors can also play a role, such as the maximum current and the operating temperature, to name just a few. For instance, minimizing the size of the coil in the handheld device will generally require using a higher electrical current from the battery power pack. The higher electrical current could then lead to issues related to overheating.

Accordingly, there is still room for many improvements in this area of technology.

SUMMARY

The proposed concept is aimed at providing a significantly improved autonomy of a portable handheld device in a liquid dispensing system. The portable handheld device, which is called an "activator", operates in conjunction with a corresponding spout. Both are configured and disposed to provide a very efficient conduction of the electromagnetic field, thereby allowing a valve member located within the spout to be moved with less electrical energy than ever before. Thus, a longer autonomy of the activator on a single charge is achieved compared to existing arrangements that would include the same battery power pack.

In one aspect, there is provided a system for dispensing a liquid from a container, the system including: an elongated spout to be mounted on the container, the spout including: a spout body made of a non-magnetically-conductive material; a valve member made of a magnetically-conductive material and located within a fluid passage extending inside the spout body, the valve member being movable between a closed position where the valve member is in engagement with a valve seat and the fluid passage is closed, and an opened position where the valve member is out of engagement with the valve seat and the fluid passage is opened; and a core plate made of a magnetically-conductive material; and a portable handheld activator having a guide hole insertable around the spout body, the activator including: a housing made of a magnetically-conductive material, the housing having a portion in direct engagement with a portion of the core plate when the activator is coupled to the spout; and at least one coil located within the housing and around the guide hole to selectively generate an electromagnetic field moving the valve member into the opened position when the activator is coupled to the spout, the electromagnetic field forming a substantially uninterrupted toric magnetic circuit passing through the valve member, the housing and the core plate.

In another aspect, there is provided a liquid dispensing spout for use with a portable handheld activator, the spout including: a valve member made of a magnetically-conductive material and located within a fluid passage extending inside the spout, the valve member being movable between a closed position where the valve member is in engagement with a valve seat and the fluid passage is closed, and an opened position where the valve member is out of engagement with the valve seat and the fluid passage is opened; a spring to generate a spring force biasing the valve member into the closed position; and a core plate made of a magnetically-conductive material, the core plate being part of a magnetic circuit created when the activator is coupled to the spout for temporarily moving the valve member from the closed position to the opened position.

In another aspect, there is provided a portable handheld activator for use with magnetically-actuated liquid dispensing spouts, the activator including: a housing made of a magnetically-conductive material; at least one coil located into the housing to selectively generate an electromagnetic field when the activator is coupled to a selected one of the spouts, the electromagnetic field actuating a valve member of the selected spout; and a battery power pack mounted on the activator, the battery power pack having enough power for at least 1200 servings of 1 ounce (29.6 ml) on a single charge.

In another aspect, there is provided a method of operating a liquid dispensing system including a portable handheld activator and a plurality of spouts mounted on respective containers containing liquids to be dispensed, the method including: selecting one of the containers; inserting the activator over the spout of the selected container; tilting the selected container from a storage position to a pouring position; generating an electromagnetic field at the activator for creating a magnetic circuit passing through the activator and the spout of the selected container, the magnetic circuit being substantially uninterrupted; pouring liquid out of the selected container through the spout using a fluid passage inside the spout that opened as a result of the electromagnetic field; interrupting a flow of the liquid inside the spout of the selected container after a given time by removing the electromagnetic field and thereby automatically closing the fluid passage; putting the selected container back into the storage position; and removing the activator from the spout of the selected container.

Details on these aspects as well as other aspects of the proposed concept will be apparent from the following detailed description and the appended figures.

DETAILED DESCRIPTION

The proposed concept relates to a portable dispensing system for liquids in containers such as bottles or the like. It is particularly well adapted for use with alcohol bottles in locations such as bars, restaurants, etc. The present concept, however, is not limited to alcohol bottles and to the aforesaid locations. Thus, although the example described hereafter and illustrated in the appended figures refers only to bottles with alcoholic beverages and the context of a bar for the sake of simplicity, it should be noted that this is only one possible example. The containers can also be containers that are not bottles.

Figure 1:
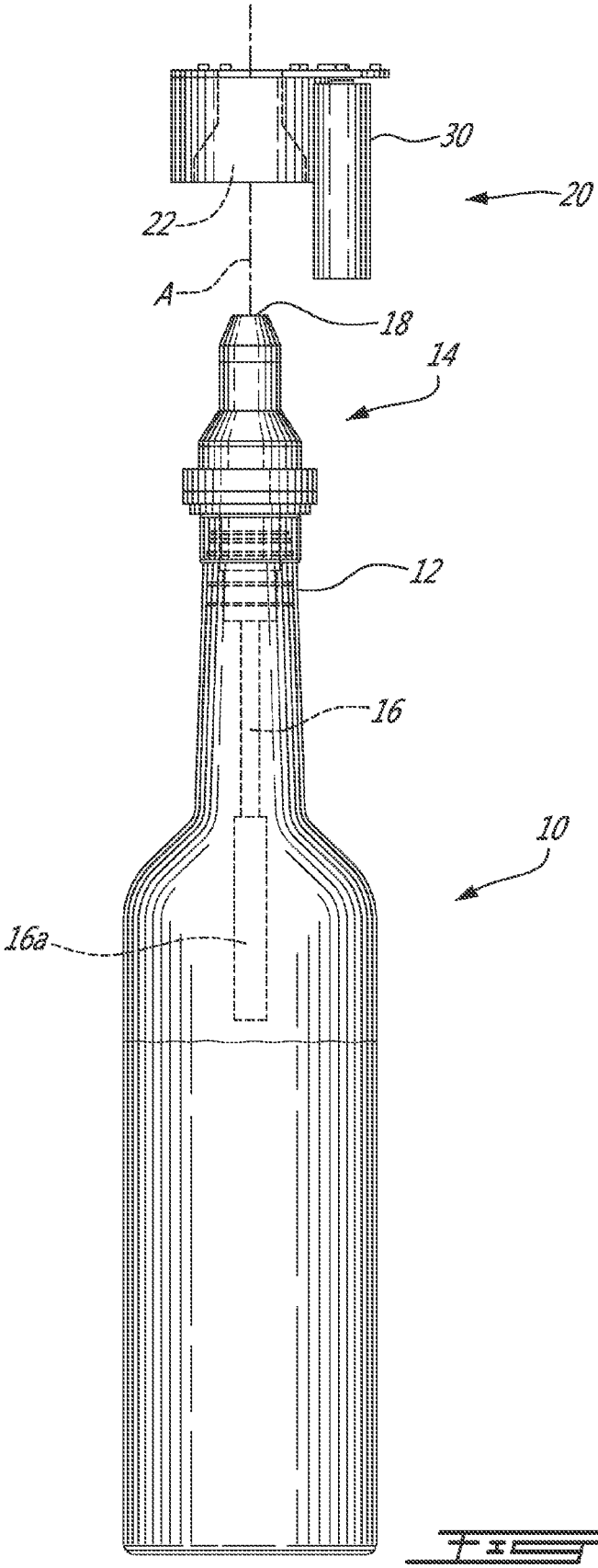
FIG. 1 is a side view illustrating an example of an activator of a liquid dispensing system and an example of a corresponding spout mounted on a generic bottle.

FIG. 1 is a side view illustrating an example of a generic bottle 10 having a neck 12 over which is mounted an example of a spout 14. The spout 14 is press-fitted onto the bottle 10 and can be sealed to the bottle 10 to prevent an unnoticed removal of the spout 14. The spout 14 can be designed to be removed from the bottle 10 only by breaking a seal. Alternatively, the spout 14 can be constructed with a temper-proof lock or the like.

The illustrated spout 14 has a main bottom portion generally extending inside the neck 12 of the bottle 10, and a main top portion generally extending above the upper edge of the neck 12. The main bottom portion of the illustrated spout 14 includes a plurality of spaced-apart flexible annular flanges 40 (FIG. 3) that are configured and disposed to engage with interference the interior wall of the neck 12 when the spout 10 mounted on the bottle 10. This prevents liquids from leaking when the bottle 10 is in a tilted position. Variants are possible as well.

The spout 14 has a vent tube circuit, which includes a vent tube 16 extending below the main bottom portion of the spout 14 and into the bottle 10. The vent tube 16 allows air to pass into the bottle 10 and replace the liquid that is poured when the bottle 10 is upside-down. The vent tube 16 is in fluid communication with a port 17 (FIG. 7) located on the side of the main bottom portion of the spout 14. A check valve **16*a*, for instance including one or more balls, is located at the inlet end of the vent tube 16 to prevent the liquid from leaking out through the port 17 when the bottle 10 is upside-down. It may also be designed for mitigating or preventing alcohol vapors from leaking out of the bottle 10 through the vent tube circuit when the bottle 10** is in a storage position. The check valve can also be located elsewhere.

The spout 14 includes a fluid passage extending from an inlet located under the main bottom portion of the spout 14 to an outlet 18 located at the tip of the spout 14 and by which the liquid contained in the bottle 10 can be retrieved. This fluid passage is normally closed so as to prevent an unauthorized pouring of the liquid from the bottle 10 and/or having an unaccounted serving.

The fluid passage inside the spout 14 can be opened by an authorized person using a portable handheld activator 20 as shown in FIG. 1. This activator 20 is designed to fit perfectly over the spout 14. The activator 20 includes a guide hole 22 configured and disposed to receive the main top portion of the spout 14. When the activator 20 is coupled to the spout 14, the tip of the spout 14 projects above the top of the activator 20 so as to minimize the likelihood of a contact between the liquid being poured and the activator 20.

Since bars or the like always have many different kinds of bottles 10, there is generally a multitude of spouts 14, one for each available bottle, and only one or a few activators 20. The same activator 20 can thus be used with several different spouts 14. If desired, each activator 20 can be assigned to a corresponding barman. Many other variants are possible.

The activator 20 is said to be portable, meaning that it does not need to be linked to an external power source through a wired connection in normal use, i.e. as when the barman is serving drinks to clients. The activator 20 is also said to be handheld, meaning that it is made as small and light as possible to facilitate its handling by the barman, as understood by a person of ordinary skill in the art.

The illustrated activator 20 is shown with a generic battery power pack 30 mounted thereon. The battery power pack 30 can include one or more batteries. The battery or batteries can be rechargeable or not. They can also be in a protective casing or not. In the illustrated example, the battery power pack 30 includes only one battery and is located on the side of the parts that fit over the spout 14. Many other configurations and arrangements are possible, including having a battery power pack that is more concealed in the activator 20. Thus, the illustrated battery power pack 30 is only one example.

Also, the word "battery" or "batteries" is used herein in a generic manner to designate a device capable of supplying electrical power without the need of being connected to an external source. If the battery power pack 30 is rechargeable, then the activator 20 can be connected to an external power source for recharging. Alternatively, one can design the battery power pack 30 to be removable or partially removable from the activator 20, such as for recharging on another device.

Figure 9:
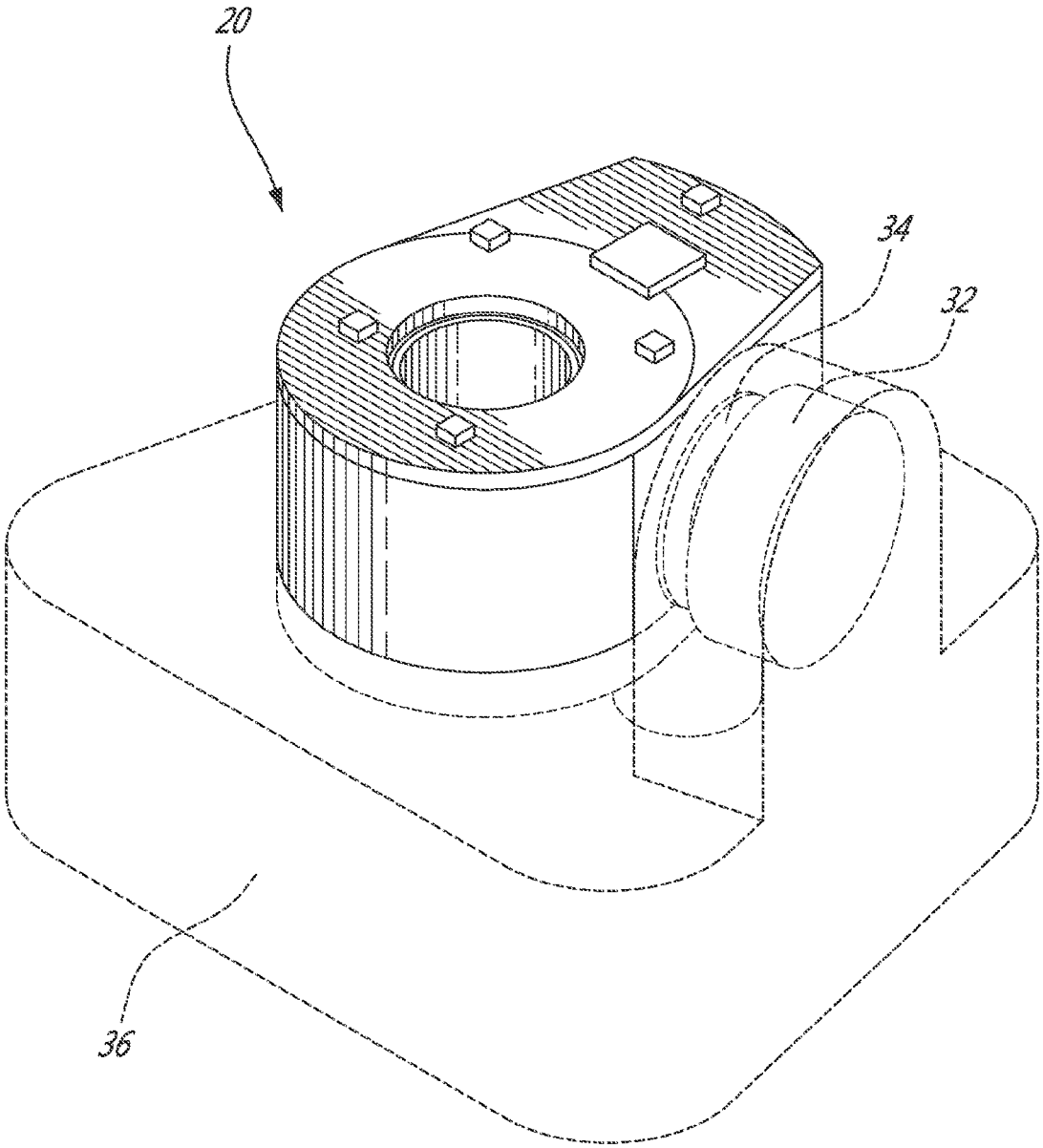
FIG. 9 is a semi-schematic view illustrating the activator shown in FIG. 1 and an example of a docking station for recharging the battery power pack of the activator.

Moreover, as shown in FIG. 9, the battery power pack 30 can be recharged using a pair of induction coils 32, 34. FIG. 9 is a semi-schematic view illustrating the activator 20 and an example of a docking station 36 for recharging the battery power pack 30. One coil 32 is provided on a docking device 36 and the other coil 34 is provided in a recess on the side of the activator 20. Both coils 32, 34 are in registry with one another when the battery power pack 30 of the activator 20 is recharged. An alternating current is supplied in the first coil 32 and this induces an alternating current in the second coil 34. This configuration simplifies the recharging process since no wire needs to be connected to the activator 20. Nevertheless, one can choose to proceed differently.

Depending on the implementations, the battery power pack 30 can be manufactured and sold with the rest of the activator 20, or it can manufactured and sold separately. One can also design the activator 20 for use with a third-party generic battery power pack 30. Other variants can be devised as well.

The battery power pack 30 provides the electrical power required to energize one or more coils that are part of an electromagnet located in the activator 20. It can also be used to operate the electronic circuitry of the activator 20. Alternatively, one could use a separate battery or set of batteries, for instance one or more miniature batteries, to power the electronic circuitry of the activator 20.

In use, when a barman receives an order for a drink, he or she inserts the activator 20 over the spout 14 of the bottle 10 containing the liquid or one of the liquids to be poured for the drink. The electromagnetic field generated by the activator 20 will open the fluid passage within the spout 14 when the bottle 10 is tilted so as to be in an upside-down or inclined position allowing the liquid to flow out of the spout 14 by gravity.

If desired, the activator 20 can also act as a metering device by only opening the fluid passage for a predetermined amount of time that corresponds to the quantity of liquid ordered or required. Since the flow rate is relatively constant each time liquid is poured from a same bottle, controlling the time the fluid passage remains open can control the amount of liquid being poured. A flow rate of about ¾ ounce per second (about 22.2 ml/s) is one example of a flow rate coming out of the fluid passage when pouring alcohol. However, the flow rate will also depend on the viscosity of the liquid. The activator 20 can be configured to calculate the appropriate time by knowing the selected amount of liquid and by having information indicative of the viscosity of the liquid.

The activator 20 can include a keyboard providing a selection of predetermined amounts of liquids, for instance ¼ ounce (7.4 ml), ½ ounce (14.8 ml), ¾ ounce (22.2 ml) and 1 ounce (29.6 ml). Other amounts and/or additional options are also possible. Alternatively, an activator can also be designed with only one available selection, for instance 1 ounce (29.6 ml). The keyboard can be in the form of one or more buttons and/or include a touch screen. Many other variants are possible as well.

Also if desired, the activator 20 can be used to record all the servings being made. Data concerning these servings can be transmitted or uploaded into a computer system from time to time and/or in real time, depending on the implementation. For instance, data can be recorded in a memory located within the activator 20 and then uploaded when charging and/or when the data can be sent in real time through a wireless communication network. This way, all transactions can be duly recorded and the bar owners can easily verify if all poured drinks generated corresponding revenues for the bar. The computer system can also be used to monitor the level of liquids remaining in the bottles 10. Variants are possible as well.

One of the main challenges in designing a liquid dispensing system having a portable handheld activator is to obtain a suitable autonomy of its battery power pack on a single charge so as to meet the requirements of the busiest bars. For instance, a busy barman can sometimes pour the equivalent of up 1200 servings of 1 ounce (29.6 ml) in a single shift. This corresponds to 30 bottles of 40 ounces (1.18 l). Having a portable handheld activator that can be used by such barman with a single charge would fulfill a very important need. Nevertheless, one can use a different target, depending on the context.

While battery capacity is constantly improving, using additional and/or more powerful batteries is often not the best option to improve autonomy, as this can result in increased manufacturing costs, weight and complexity. Instead, the approach of the proposed concept is to significantly improve the efficiency of the magnetic circuit generated by the electromagnetic field of the activator 20 to open the fluid passage inside the spout 14. The improved efficiency means that less electrical power is need from the battery power pack 30 to open the fluid passage inside the spout 14, thus the number of servings of the activator 20 with a single charge is improved.

For example, it was found that using the proposed concept and a battery power pack 30 having a single 3.3V battery with a capacity of about 500 mAh when fully charged and capable of providing a maximum output current of about 3 A, the number of servings can reach 4000, thus more than the target of 1200 servings. This is a significant improvement over existing devices.

Figure 2:
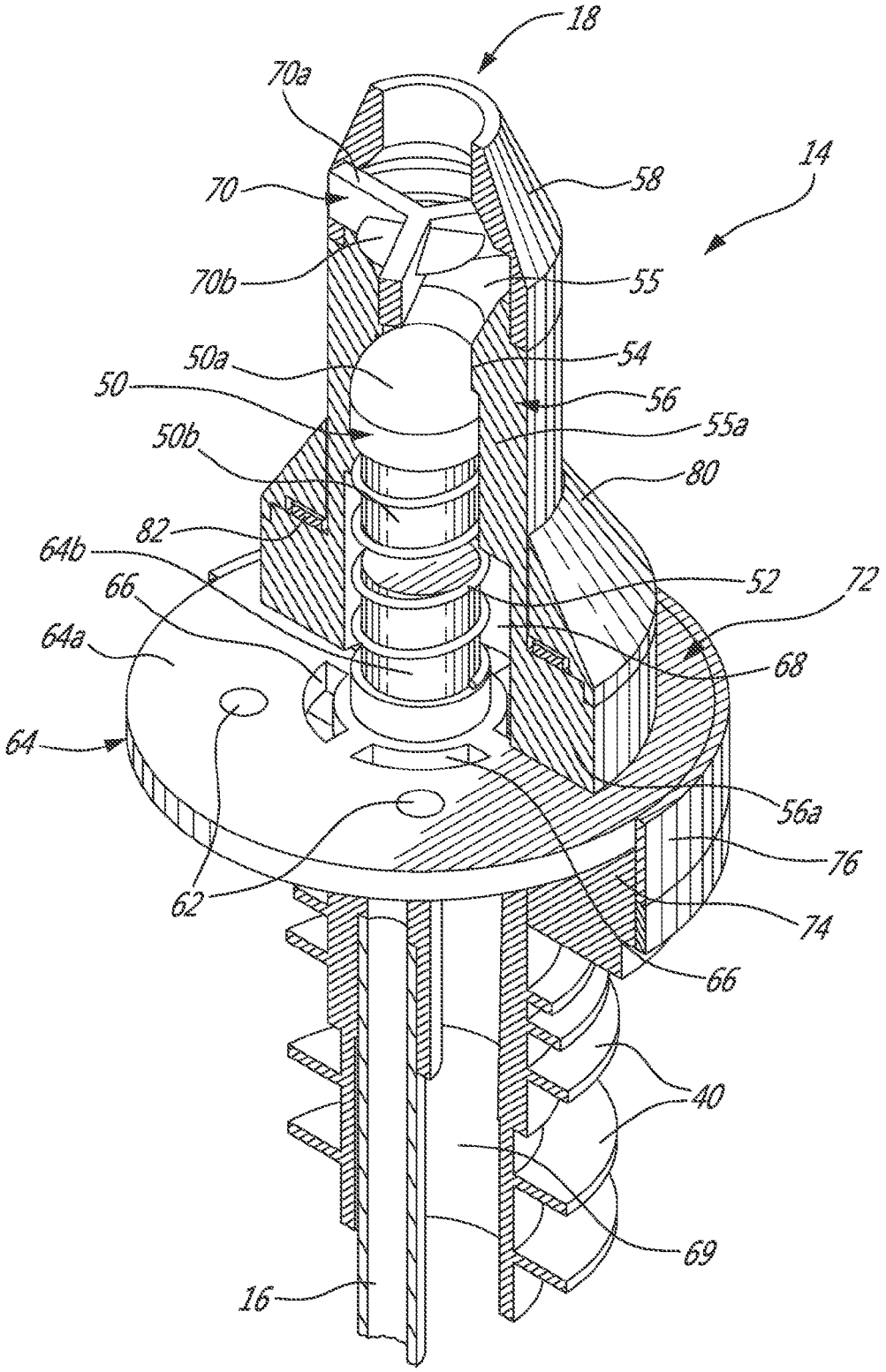
FIG. 2 is a vertical cross sectional view of the spout shown in FIG. 1.
Figure 3:
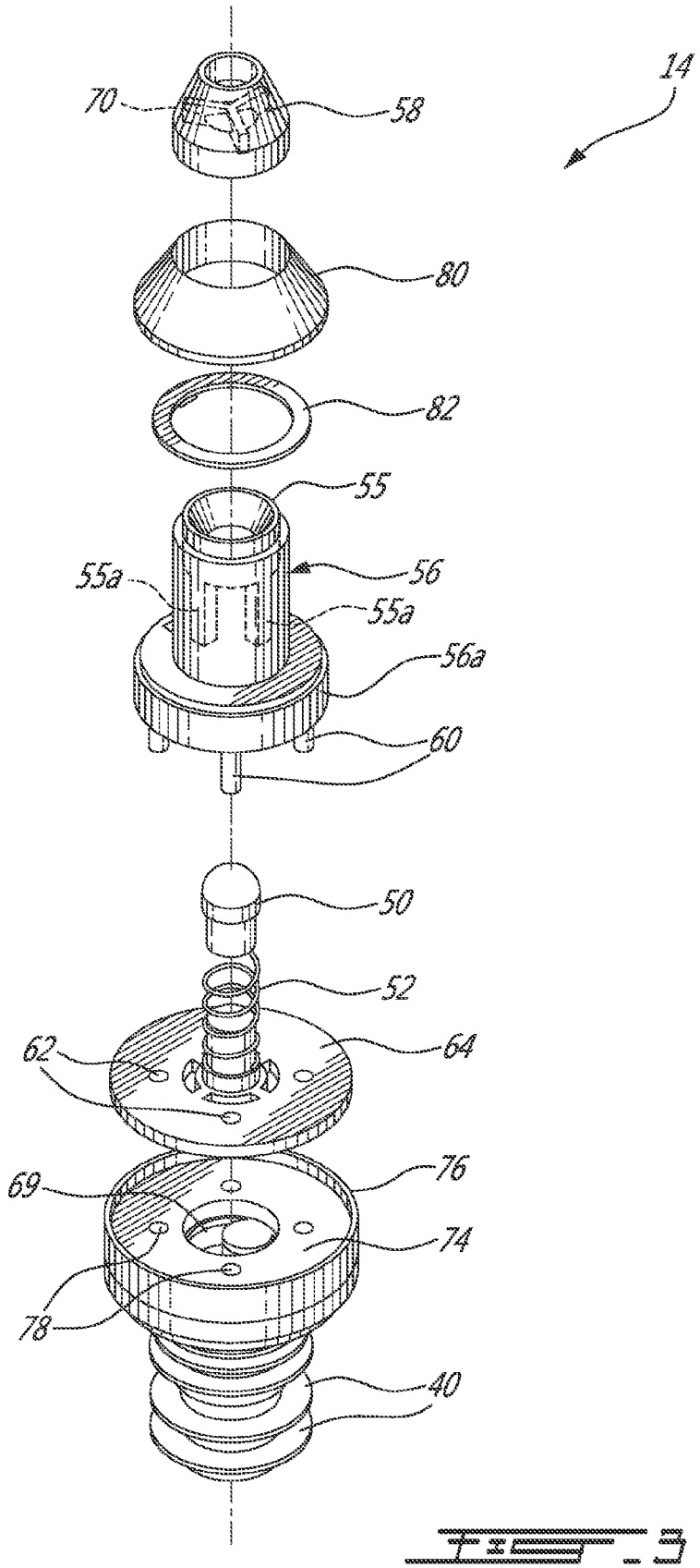
FIG. 3 is an exploded view of the spout shown in FIG. 1.
Figure 4:
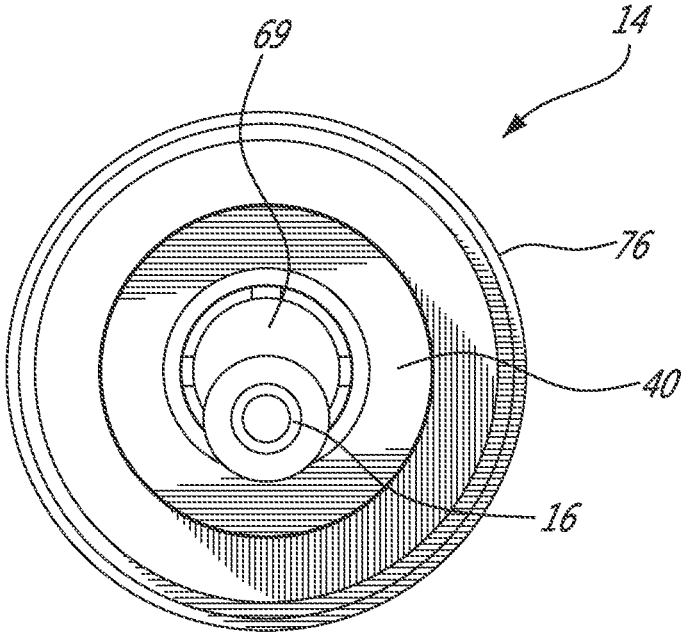
FIG. 4 is a bottom view of the spout shown in FIG. 1.

FIGS. 2 and 3 are a vertical cross sectional view and an exploded view of the spout 14 shown in FIG. 1, respectively. FIG. 4 is a bottom view of the spout 14 shown in FIG. 1.

The spout 14 is generally constructed around a central longitudinal axis A that is coaxial with the center of the neck 12. It includes a valve member 50 located within the fluid passage.

In use, the valve member 50 is selectively movable between a closed position and an opened position. The valve member 50 is moved to the opened position using the electromagnetic field. The valve member 50 is otherwise normally maintained in the closed position using a spring, for instance a helical compression spring 52 as shown in the illustrated example. The spring 52 generates a spring force biasing the valve member 50 into the closed position, where the valve member 50 is in engagement with an internal valve seat 54 and the fluid passage is closed. In the opened position, the valve member 50 is out of engagement with the valve seat 54 and the fluid passage is opened. As shown in FIG. 2, the valve member 50 and the spring 52 of the illustrated example are coaxially disposed with reference to the longitudinal axis A. Other configurations and arrangements are possible. For instance, other kinds of springs can be used inside the spout 14.

Moving the valve member 50 from the closed position towards the opened position initially requires a relatively strong electromagnetic field compared to the one required for maintaining the valve member 50 at the opened position. The back pressure from the liquid when the bottle 10 is upside-down and the adhesion forces created by the sugar in the liquids are two examples of additional factors requiring an increased initial pulling force. Once the valve member 50 reaches the opened position, the current can be reduced to save energy.

The valve member 50 is made of a magnetically-conducting material, for instance magnetic stainless steel for use in connection with foods products. Other materials can be used as well, depending on the context.

The illustrated valve member 50 has a rounded upper head 50*a* and an elongated cylindrical body 50*b* at the bottom. The rounded shape of the upper head 50*a* can facilitate the re-alignment of the valve member 50, and will still block the flow of liquid when the valve member returns without being perfectly in alignment with the longitudinal axis. The cylindrical body 50*b* receives one end of the spring 52. In the closed position, the head 50*a* engages the interior of an internal valve seat 54. The valve seat 54 is molded inside a larger elongated and generally cylindrical member 56 that is part of the body of the spout 14. A conical tip 58 fits over a recessed upper edge of the cylindrical member 56 and is permanently attached thereto, for instance using glue. The conical tip 58 is also part of the spout body. Variants in the construction of the valve member 50 and/or in the construction of the other parts of the spout 14 are possible.

As best shown in FIG. 3, the interior portion 55 of the member 56 of the illustrated example includes the valve seat 54 but it also includes a set of three axisymmetric and elongated internal guide members 55*a* located below the valve seat 54. The interior of the guide members 55*a* is in sliding engagement with the exterior of the head 50*a* of the valve member 50. The guide members 55*a* also facilitate the flow of liquid around the valve member 50 in the open position.

The cylindrical member 56 and the conical tip 58 can be made of a plastic material. Other materials are possible as well.

In the illustrated example, the cylindrical member 56 includes an enlarged annular base 56*a*. A plurality of axisymmetric pegs 60 (visible in FIG. 3) projects from the bottom side of the outer annular base 56*a*. These pegs 60 can be inserted through corresponding holes 62 made across a core plate 64. The pegs 60 provide the physical connection between the main top portion and the main bottom portion of the illustrated spout 14.

The core plate 64 is made of a magnetically-conducting material, for instance magnetic stainless steel for use in connection with foods products. Other materials than can be used as well. The core plate 64 of the illustrated example includes a first and a second portion, namely in the case a substantially flat disc-shaped portion 64*a* and an upper cylindrical portion 64*b* projecting perpendicularly from the center of the top side face of the disc-shaped portion 64*a*. Both portions 64*a*, 64*b* are made integral with one another. For instance, they can be molded together or made separately and then welded or otherwise connected together. In the illustrated example, the disc-shaped portion 64*a* and the upper cylindrical portion 64*b* are coaxially-disposed with reference to the longitudinal axis A. The disc-shaped portion 64*a* extends substantially radially with reference to the longitudinal axis A. The upper cylindrical portion 64*b* receives one end of the spring 52. Variants are possible as well.

Four axisymmetric arc-shaped openings 66 are made through the disc-shaped portion 64*a*, around the cylindrical portion 64*b*, of the illustrated example. These openings 66 are part of the fluid passage and provide a pathway for the liquid into the bottle 10 up to a chamber 68 located above the valve member 50 when the bottle 10 is set upside-down. The liquid thus flows from the bottle 10, to the passage 69 inside the first portion of the spout 14, and then through the openings 66. Variants are possible as well, for instance in the number and/or the shape and/or the position of the openings 66.

As can be seen in FIG. 2, the disc-shaped portion 64*a* of the core plate 64 is made larger than the outer annular base 56*a* of the cylindrical member 56. This creates an exposed outer annular surface 72. The bottom side of the core plate 64 is inserted into the top section of a base 74 that is made of a plastic material and/or another material. The periphery of the core plate 64 is surrounded by a vertical wall 76. As shown in FIG. 3, the base 74 includes holes 78 for receiving the bottom end of the pegs 60 when the spout 14 is assembled. The pegs 60 can be glued, welded or otherwise attached to the base 74.

A guard member 70 is positioned between the tip 58 and the valve seat 54 to prevent the valve member 50 from being easily actuated along a linear path using a rigid object, for instance a paper clip wire or the like, inserted through the tip 58. This scenario can be done thereby allowing an unauthorized person to retrieve some or even all of the bottle content. The guard member 70 is configured and disposed to create a baffle around which the liquid from the bottle 10 can circulate when the fluid passage is opened, but that provides no linear path toward the valve member 50 from outside the spout 14. As shown in FIG. 2, the illustrated guard member 70 includes three rectangular parts 70*a* connected at the center and three rounded flanges 70*b* extending between the three parts 70*a*. Variants are possible as well.

An outer conical member 80 is inserted around the cylindrical member 56 down to its enlarged annular base 56*a*. The outer conical member 80 is positioned on an exterior side of the spout 14. It has a bottom diameter similar to the external diameter of the enlarged annular base 56*a*. The conical member 80 can be made of a plastic material and/or another material. It reinforces the cylindrical member 56 and can also prevent or mitigate the risk of having someone openings the valve member 50 using an external magnet to steal the bottle content.

The activator 20 is also funnel-shaped, whereby the opening is larger at the bottom than at the top of the activator 20. This facilitates the positioning over the spout 14.

In the illustrated example, an annular radio-frequency identification (RFID) tag 82 is provided between the outer annular base 56*a* and the conical member 80. This way, each spout 14 can have its own ID number that can be read by the activator 20 using the RFID tag 82. Other kinds of wireless tags can also be used.

Depending on the context and the exact needs, one can also use other kinds of arrangements for such identification, or not use identification at all.

Figure 5:
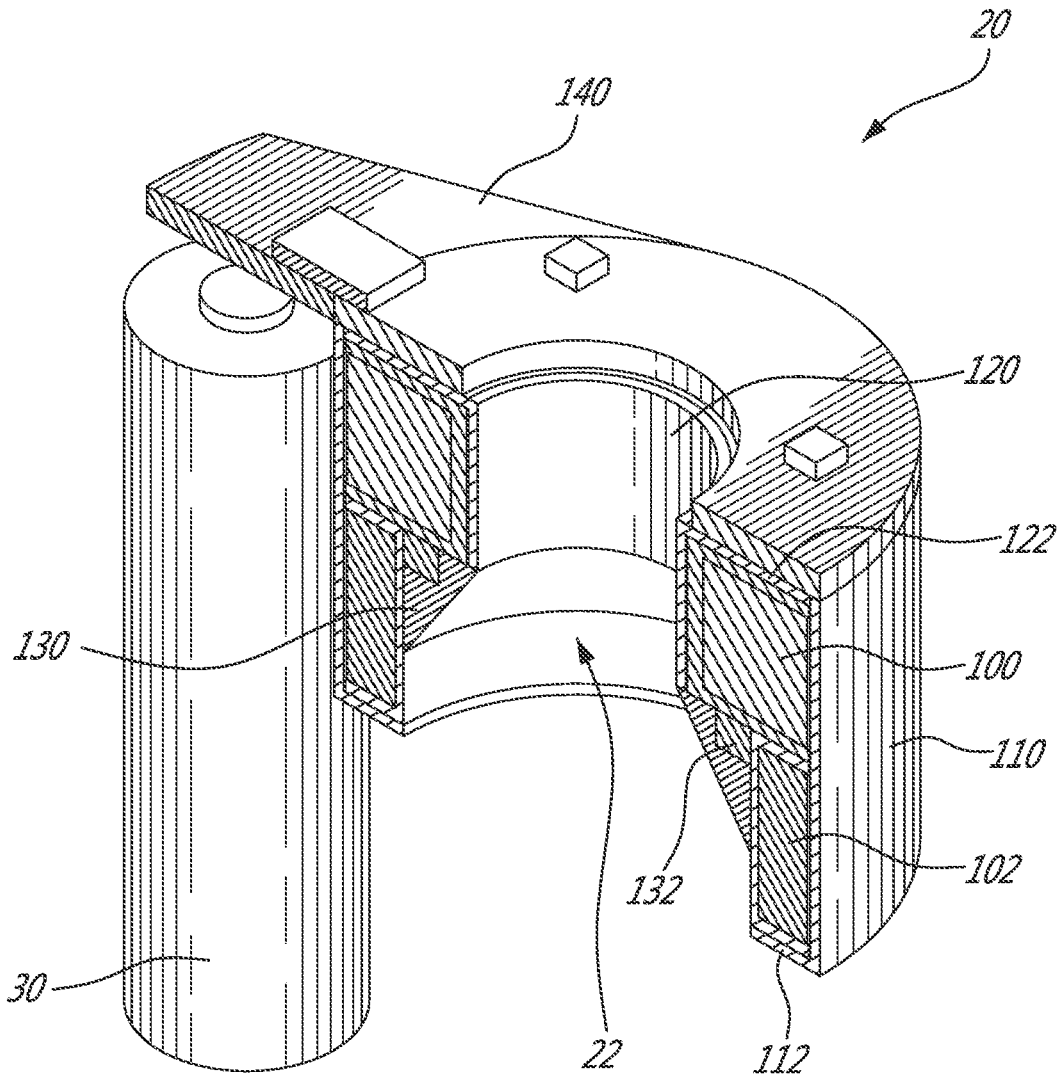
FIG. 5 is a vertical cross sectional view of the activator shown in FIG. 1.
Figure 6:
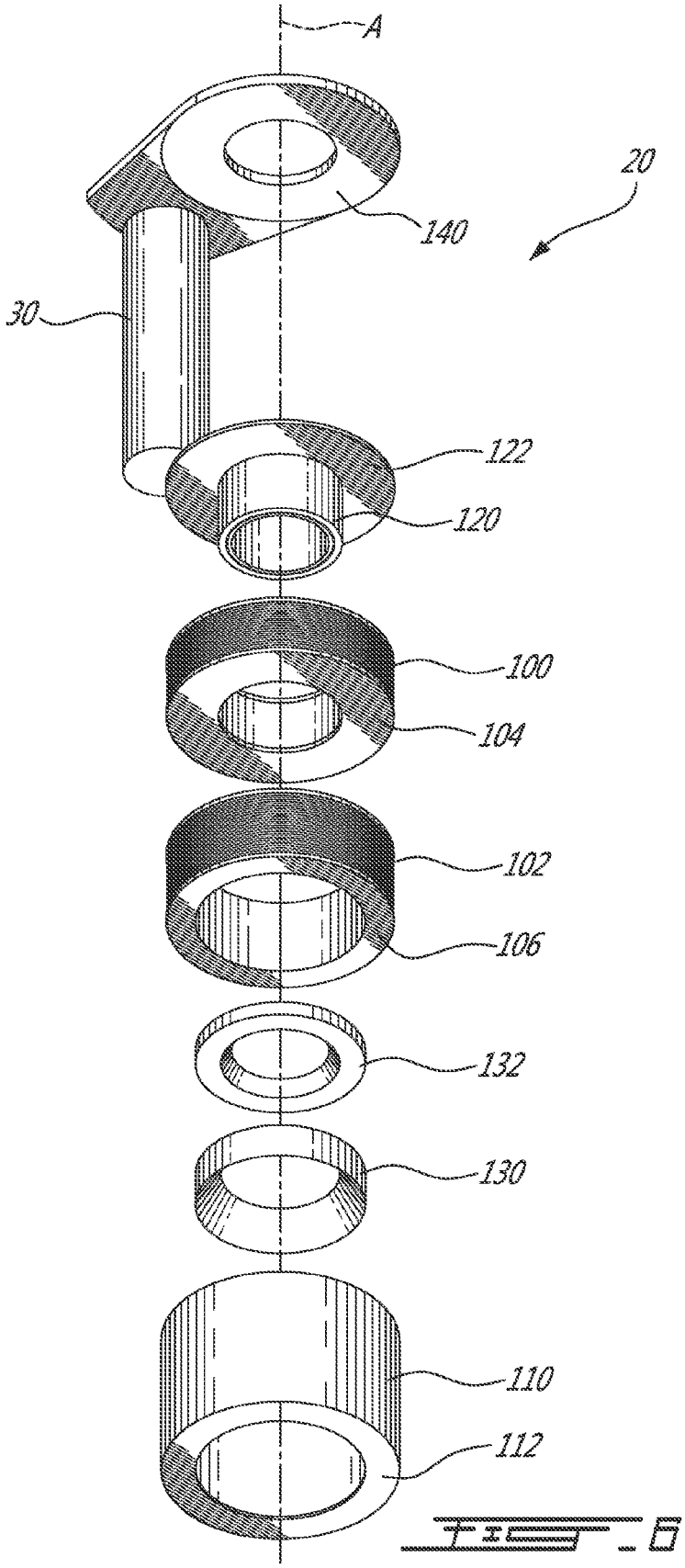
FIG. 6 is an exploded view of the activator shown in FIG. 1.

FIGS. 5 and 6 are a vertical cross sectional view and an exploded view of the activator 20 shown in FIG. 1, respectively. As can be seen, the illustrated activator 20 includes a main coil 100 and a secondary coil 102. These coils 100, 102 are connected in series, although other configurations are also possible. Each coil 100, 102 is made of a multitude of wires, for instance wires made of copper, wound around a corresponding bobbin 104, 106, respectively. Each bobbin 104, 106 is made of a non-conductive material. The wires are wound in the same direction in the illustrated example. The main coil 100 and the secondary coil 102 are coaxially disposed with reference to the longitudinal axis A.

The secondary coil 102 is provided in the illustrated example to increase the ohmic resistance and to fine tune the current in the primary coil 100. The secondary coil 102 also increases the electromagnetic field, unlike a simple resistance would do. It is possible to omit the secondary coil 102 in some implementations, or even to use an additional coil in others.

As aforesaid, the coils 100, 102 do not always be connected in series. Some implementations can use coils in parallel.

The main coil 100 and the secondary coil 102 of the illustrated example are located inside a housing made of a magnetically-conductive material. This housing includes an outer cylindrical member 110 and a bottom annular plate 112 extending radially inwards with reference to the rest of the outer cylindrical member 110. The bottom annular plate 112 is made integral with the outer cylindrical member 110 and is made of the same material. The housing also includes an inner cylindrical member 120 and an upper annular plate 122. The upper annular plate 122 includes an opening defining the top portion of the guide hole 22. The inner cylindrical member 120 is coaxially disposed with reference to the guide hole 22 and extends downwardly from the upper annular plate 122. Both are made integral with one another. The inner cylindrical member 120 is shorter than the outer cylindrical member 110. In other words, the inner cylindrical member 120 is only partially extending downwardly along the guide hole 22. Variants are possible. The various parts of the housing are made of a magnetically-conducting material, for instance magnetic stainless steel for use in connection with foods products. Other materials can be used as well, depending on the context. The outer cylindrical member 110, the bottom annular plate 112, the inner cylindrical member 120 and the upper annular plate 122 forming the housing create an uninterrupted portion of the magnetic circuit of the activator 20.

It should be noted that the various parts of the housing, as well as the other parts of the system that are made of a magnetically-conducting material, do not necessarily need to be all made of exactly the same material.

Below the inner cylindrical member 120 of the illustrated example is located an inverted conical member 130. This inverted conical member 130 can be made for instance of a plastic material and/or another material. It has a shape complementary to that of the conical member 80 of the spout 14. This configuration acts as a guide and it facilitates the positioning of the activator 20 over the spout 14.

The inverted conical member 130 also covers an RFID antenna 132 provided to probe the RFID tag 82 of the spout 14 when the activator 20 is inserted thereon. Variants are possible as well. Thus, the activator 20 can be configured to identify the bottle and, for instance, check if the barman to which the activator 20 was assigned is authorized to pour liquid from the bottle 10. The activator 20 can also calculate the appropriate time during which the fluid passage will be opened so as to pour the selected quantity of liquid. As aforesaid, the exact time will also depend on the viscosity of the liquid. A thicker liquid will flow more slowly than a very light one.

The activator 20 of the illustrated example further includes a circuit plate 140 located on the top of the activator 20. The circuit plate 140 can include a microprocessor, a memory, the keyboard 142 (schematically depicted in FIG. 8), light indicators and various other components to connect the different parts of the activator 20. The memory has a capacity of recording all the transactions, for instance up to 1200 transactions or more, depending on the implementations.

Figure 7:
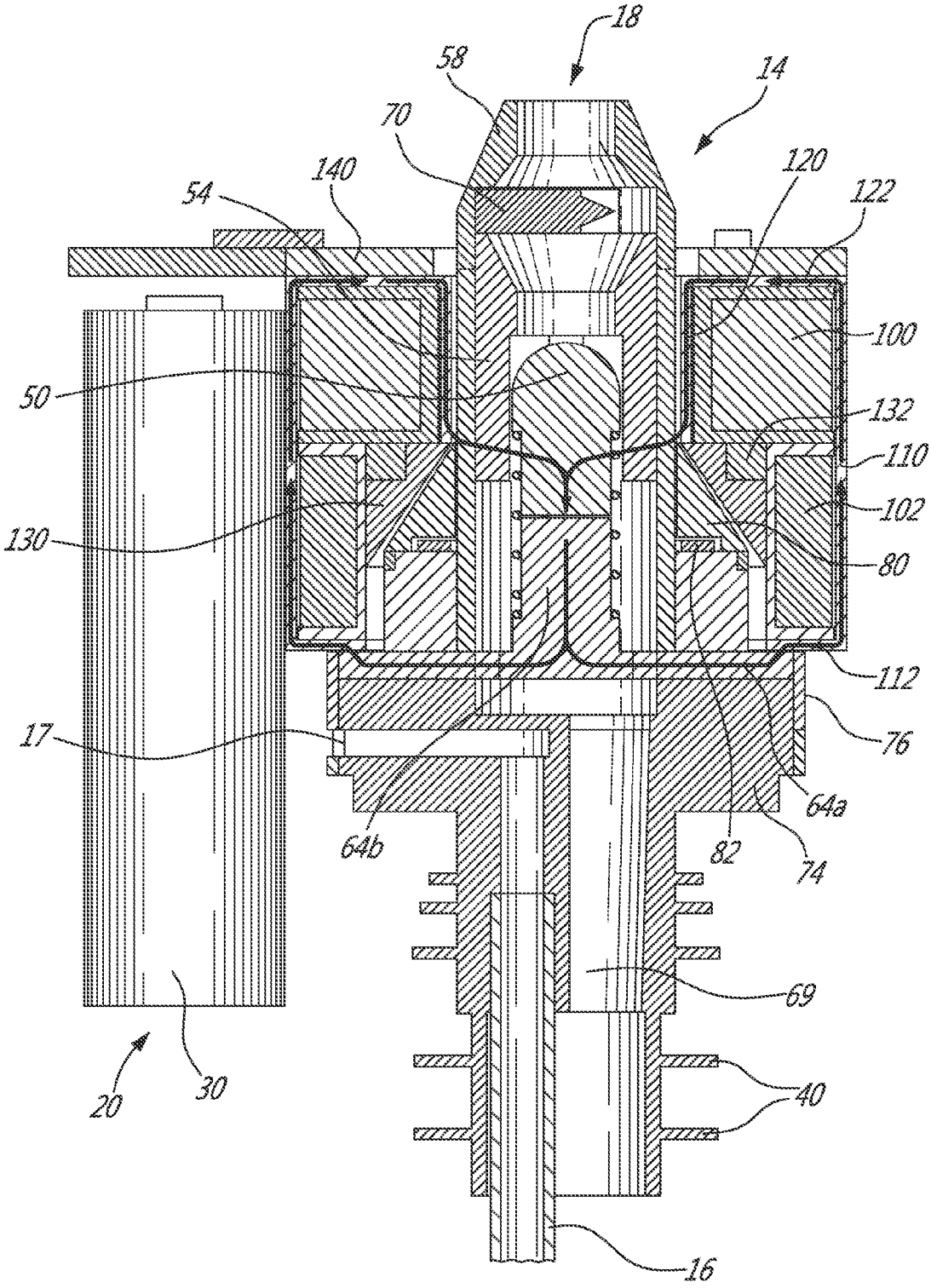
FIG. 7 is a vertical cross sectional view of the activator and of the spout shown in FIG. 1 when the electromagnetic field is activated.

FIG. 7 is a vertical cross sectional view of the activator 20 and of the spout 14 of FIG. 1 when the electromagnetic field is activated. The spout 14 is shown in an opened position. FIG. 7 is not illustrated upside-down for the sake of clarity. Connection wires and other similar components are not shown in the figures. In practice, the activator 20 can be designed to only open the fluid passage of the spout 14 if the bottle 10 is upside-down. It can include for instance a sensor to detect the orientation of the bottle 10. This way, the fluid passage cannot be opened unless the bottle 10 is tilted upside-down or sufficiently inclined. The sensor can be for instance integrated on the circuit plate 140 and linked to the microprocessor of the activator 20. Other configurations and arrangements are also possible.

In use, as schematically depicted in FIG. 7 using arrows, the magnetic circuit generated by the electromagnetic field from the activator 20 when it is coupled to the spout 14 moves the valve member 50 away from its valve seat 54. In the illustrated example, the valve member 50 is against the cylindrical portion 64*b* of the core plate 64 when it is in an opened position. The upper head 50*a* of the valve member 50 and the interior of the valve seat 54 have a relatively large space between them when the valve member 50 is in the opened position. This provides the required space for the liquid to flow when the bottle 10 is upside-down.

As can be appreciated, the design of the activator 20 and the spout 14 forms a compact and substantially uninterrupted toric magnetic circuit passing through the disc-shaped portion 64*a* of the core plate 64, the cylindrical portion 64*b* of the core plate 64, the valve member 50 and the housing formed by the inner cylindrical member 120, the upper annular plate 122, the outer cylindrical member 110 and the bottom annular plate 112. A portion of the bottom annular plate 112 and a portion of the disc-shaped portion 64*a* are in direct engagement with one another. The interface between them is annular shaped and is continuous in the illustrated example. The annular-shaped interface could be segmented in some implementations. In the illustrated example, the magnetic circuit is only interrupted when it goes across the spout body and also when there is an air gap between the valve member 50 and the cylindrical portion 64*b* of the core plate 64.

Overall, the proposed concept greatly improves the efficiency of the electromagnetic field since most of the path of the magnetic circuit goes uninterruptedly through the magnetically-conductive material parts. In particular, the magnetic circuit is uninterrupted between the housing of the activator 20 and the core plate 64. The electromagnetic field is also concentrated at the center where the bottom of the valve member 50 is located. Therefore, the electrical energy required to energize the coils 100, 102 and produce the force required to move the valve member 50 is minimized and the autonomy of the activator 20 is increased.

It should be noted that in the disc-shaped portion 64*a* of the illustrated core plate 64, the magnetic circuit passes through radially-extending bridges between the ends of the openings 66.

Figure 8:
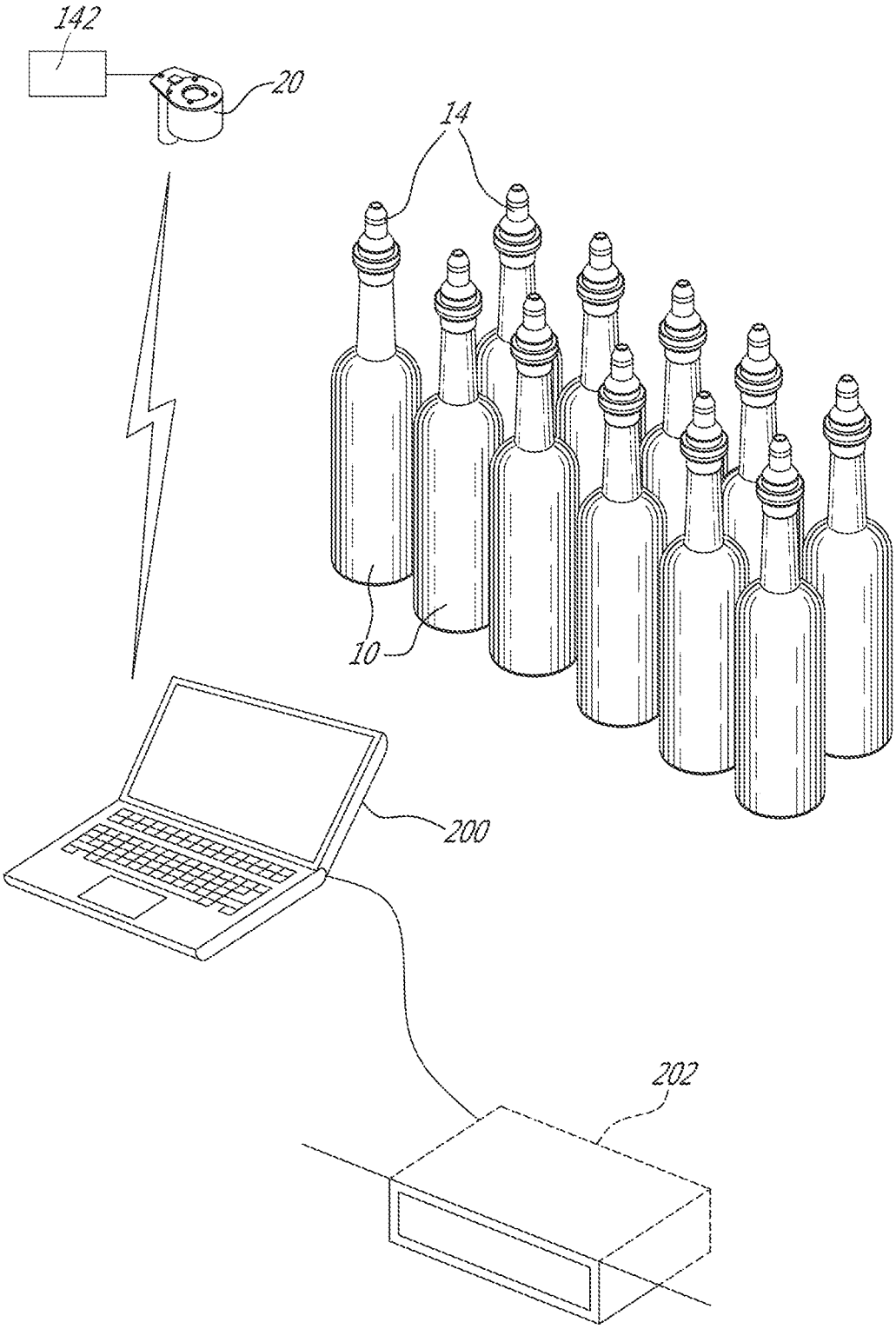
FIG. 8 is a semi-schematic view illustrating an example of a computer system for managing the liquid dispensing system of FIG. 1.

FIG. 8 is a semi-schematic view showing an example of a computer system 200 for managing the liquid dispensing system of FIG. 1. As can be seen, the illustrated computer system 200 and the activator 20 can communicate wirelessly with one another to exchange data signals. As aforesaid, this can be done either in real time or at given intervals. The computer system 200 can also be used to compare the value of the servings recorded at the activator 20 and the revenues recorded in the cash register 202. Many variants are possible as well.

Overall, the proposed concept provides a very efficient design to increase the efficiency of the electromagnetic field and decrease the energy requirement from the battery power pack 30 of the portable handheld activator 20.

The present detailed description and the appended figures are meant to be exemplary only. A skilled person will recognize that variants can be made in light of a review of the present disclosure without departing from the proposed concept.

What is claimed is:

1. A system for dispensing a liquid from a container, the system including:

an elongated spout to be mounted on the container, the spout including:

a spout body made of a non-magnetically-conductive material;

a valve member made of a magnetically-conductive material and located within a fluid passage extending inside the spout body, the valve member being movable between a closed position where the valve member is in engagement with a valve seat and the fluid passage is closed, and an opened position where the valve member is out of engagement with the valve seat and the fluid passage is opened; and a core plate made of a magnetically-conductive material, said core plate being larger in width than the spout body; and a portable handheld activator having a guide hole, the activator being removably insertable around the spout body, the activator including:

a housing made of a magnetically-conductive material, the housing having a portion in direct engagement with a portion of the core plate when the activator is coupled to the spout; and at least one coil located within the housing and around the guide hole to selectively generate an electromagnetic field moving the valve member into the opened position when the activator is coupled to the spout, the electromagnetic field forming a substantially uninterrupted toric magnetic circuit passing through the valve member, the housing and the core plate.

2. The system as defined in claim 1, wherein the activator includes a battery power pack mounted on the activator, the at least one coil being powered using electrical power from the battery power pack.

3. The system as defined in claim 1, wherein the portion of the housing and the portion of the core plate are in direct engagement with one another, when the activator is coupled to the spout, through an exposed surface of the core plate with which the portion of the housing is engaged, the core plate and the housing forming an uninterrupted part of the magnetic circuit.

4. The system as defined in claim 1, wherein the core plate includes a first substantially flat portion and a second portion, the second portion projecting perpendicularly from a center of the first portion, the first portion and the second portion of the core plate being made integral with one another.

5. The system as defined in claim 4, wherein the first portion of the core plate is disc-shaped and extends substantially radially with reference to a longitudinal axis of the spout, the second portion of the core plate being cylindrical and substantially in registry with the longitudinal axis of the spout.

6. The system as defined in claim 5, wherein the valve member is substantially in registry with the longitudinal axis of the spout and engages the second portion of the core plate when the valve member is in the opened position.

7. The system as defined in claim 4, wherein the first portion of the core plate includes at least one opening that is part of the fluid passage.

8. The system as defined in claim 7, wherein the at least one opening includes a plurality of axisymmetric arc-shaped openings.

9. The system as defined in claim 1, wherein the spout includes a main top portion and a main bottom portion, the main bottom portion having a bottom section configured and disposed to be inserted with an interfering engagement onto the container.

10. The system as defined in claim 9, wherein the main bottom portion includes a top section located above and made integral with the bottom section, the top section being larger in width than the bottom section and being larger in width than a periphery of the core plate.

11. The system as defined in claim 10, wherein at least a part of the core plate extends outside the spout body.

12. The system as defined in claim 10, wherein the main bottom portion includes a vent passage having an inlet located on a side of the top section and an outlet located in the bottom section, the outlet located in the bottom section being configured and disposed to receive one end of an elongated vent tube extending toward a bottom of the container.

13. The system as defined in claim 12, wherein the vent tube includes a check valve.

14. The system as defined in claim 9, wherein the main bottom portion and the main top portion of the spout are interconnected using a set of axisymmetric pegs extending through corresponding holes made across the core plate.

15. The system as defined in claim 1, wherein the spout includes a spring to generate a spring force biasing the valve member into the closed position.

16. The system as defined in claim 1, wherein the at least one coil includes a main coil and a secondary coil, both being wound in a same direction.

17. The system as defined in claim 1, wherein the spout includes a guard member located across the fluid passage between a tip of the spout and the valve seat, the guard member partially blocking the fluid passage against an unauthorized manual actuation of the valve member using a rigid object inserted through the tip.

18. The system as defined in claim 17, wherein the guard member includes three rectangular parts connected at their center and three rounded flanges extending between the three parts.

19. The system as defined in claim 2, wherein the activator has an autonomy of at least 1200 servings of 1 ounce (29.6 ml) on a single charge of the battery power pack.

20. The system as defined in claim 1, wherein the system includes a computer system exchanging data signals with the activator.

21. The system as defined in claim 20, wherein at least some of the data signals are exchanged between the activator and the computer system through a wireless communication network.

22. The system as defined in claim 1, wherein the spout includes a wireless tag and the activator includes an antenna to read the wireless tag on the spout.

23. The system as defined in claim 1, wherein the non-magnetically-conductive material of the spout body is a plastic material.

24. The system as defined in claim 1, wherein the activator includes a keyboard linked to a microprocessor of the activator, the microprocessor controlling a duration of the electromagnetic field in response to a command entered on the keyboard by a user, the command being indicative of a quantity of the liquid to be poured from the container.

25. The system as defined in claim 24, wherein the activator includes a sensor to detect an orientation of the container, the sensor being connected to the microprocessor.

26. The system as defined in claim 1, wherein the container is a bottle, for instance a bottle containing an alcoholic beverage.

27. The system as defined in claim 1, wherein the housing includes an outer cylindrical member, an upper annular plate and an inner cylindrical member, the inner cylindrical member being shorter than the outer cylindrical member, the inner cylindrical member being coaxially disposed with reference to the guide hole and extending downwardly from the upper annular plate.

28. The system as defined in claim 1, wherein the spout body includes a set of three axisymmetric and elongated internal guide members positioned around the valve member.

29. The system as defined in claim 1, wherein the spout includes an enlarged outer member positioned on an exterior side of the spout body and located immediately above the core plate, the enlarged outer member being made of a non-magnetically-conductive material.

30. The system as defined in claim 29, wherein the core plate includes an exposed surface extending beyond an outer periphery of the enlarged outer member.

31. The system as defined in claim 29, wherein the core plate includes at least one opening that is part of the fluid passage inside the spout body.

32. A liquid dispensing spout for use with a portable handheld activator, the spout including:

a spout body;

a valve member made of a magnetically-conductive material and located within a fluid passage extending inside the spout body, the valve member being movable between a closed position where the valve member is in engagement with a valve seat and the fluid passage is closed, and an opened position where the valve member is out of engagement with the valve seat and the fluid passage is opened;

a spring to generate a spring force biasing the valve member into the closed position; and a core plate made of a magnetically-conductive material, the core plate being part of a magnetic circuit created when the activator is coupled to the spout for temporarily moving the valve member from the closed position to the opened position, the core plate being larger in width than the spout body.

33. A portable handheld activator for use with the spout as defined in claim 32, the activator including:

a housing made of a magnetically-conductive material;

a battery power pack mounted on the activator; and at least one coil located into the housing to selectively generate an electromagnetic field, when the activator is coupled to the spout, using electrical energy from the battery power pack, the electromagnetic field actuating the valve member of spout.

34. The portable handheld activator as defined in claim 33, wherein the activator has enough power for at least 1200 servings of 1 ounce (29.6 ml) using only the battery power pack on a single charge.

35. The portable handheld activator as defined in claim 33, wherein the housing includes a bottom plate having a portion that is in direct engagement with a portion of the core plate when the activator is coupled the spout, the bottom plate being larger in width than the core plate.

36. The system as defined in claim 35, wherein the housing is in direct engagement with an exposed surface of the core plate.

37. A system for dispensing a liquid from a container, the system including:

an elongated spout to be mounted on the container, the spout including:

a spout body made of a non-magnetically-conductive material, the spout body having a fluid passage extending inside the spout body;

a valve member made of a magnetically-conductive material and located inside the spout body, the valve member being movable between a closed position where the valve member is in engagement with a valve seat and the fluid passage inside the spout body is closed, and an opened position where the valve member is out of engagement with the valve seat and the fluid passage is opened; and a core plate made of a magnetically-conductive material, the core plate including at least one opening that is part of the fluid passage, said core plate being larger in width than the spout body; and a portable handheld activator having a guide hole, the activator being removably insertable around the spout body, the activator including:

a housing made of a magnetically-conductive material, the housing having a portion engaging a portion of the core plate when the activator is coupled to the spout; and at least one coil located within the housing and around the guide hole to selectively generate an electromagnetic field moving the valve member into the opened position when the activator is coupled to the spout, the electromagnetic field forming a substantially uninterrupted toric magnetic circuit passing through the valve member, the housing and the core plate.

38. The system as defined in claim 37, wherein the at least one opening includes a plurality of axisymmetric arc-shaped openings.

39. The system as defined in claim 37, wherein the activator includes a battery power pack on the activator, the at least one coil being powered using electrical power from the battery power pack to generate the electromagnetic field.

40. The system as defined in claim 37, further including an enlarged outer member positioned on an exterior side of the spout body and located immediately above the core plate, the outer member being made of a non-magnetically-conductive material.

* * * * *